United States Patent [19]

Kawamura et al.

[11] Patent Number: 4,965,566

[45] Date of Patent: Oct. 23, 1990

[54] SIGNAL ELECTRODE DRIVE CIRCUIT FOR IMAGE DISPLAY APPARATUS OPERABLE UNDER LOW FREQUENCY

[75] Inventors: Masao Kawamura; Minoru Usui, both of Tokyo, Japan

[73] Assignee: Casio Computer Co., Ltd., Tokyo, Japan

[21] Appl. No.: 276,410

[22] Filed: Nov. 25, 1988

[30] Foreign Application Priority Data

Nov. 30, 1987 [JP] Japan ..... 62-302723

[51] Int. Cl.[5] ..... G09G 3/20

[52] U.S. Cl. ..... 340/793; 340/811; 340/784

[58] Field of Search ..... 340/765, 784, 718, 719, 340/793, 811, 802, 803; 350/332, 333; 358/230, 236, 241

[56] References Cited

U.S. PATENT DOCUMENTS 4,031,541 6/1977 Arisawa et al. .
4,447,812 5/1984 Soneda et al. ..... 340/784
4,581,654 4/1986 Kobayashi et al. .
4,591,902 5/1986 Masubuchi ..... 358/59
4,600,274 7/1986 Morozumi .
4,822,142 4/1989 Yasui ..... 340/784

*Primary Examiner*—Jeffery A. Brier
*Attorney, Agent, or Firm*—Frishauf, Holtz, Goodman & Woodward

[57] ABSTRACT

In a signal electrode drive circuit of an image display apparatus, the latch pulses are sequentially shifted for a plurality of latch circuits so as to sequentially latch the digital image data, and the signal electrode of the dot-matrix type display panel is driven by the signal having a plurality of gradation, based upon the digital image data latched in the latch circuits. The image input data are alternately read out via the buffer circuits by two-phase clock pulses, the input data are transferred to the latch circuits in response to the two-phase clock pulses, and, as a consequence, image data of higher transfer frequency can be satisfactorily processed.

10 Claims, 7 Drawing Sheets

SIGNAL ELECTRODE DRIVE CIRCUIT FOR IMAGE DISPLAY APPARATUS OPERABLE UNDER LOW FREQUENCY

BACKGROUND OF THE INVENTION

1. Field of the Invention

The present invention generally relates to an image display apparatus capable of gradation-displaying information data on a dot-matrix type display panel such as a liquid crystal display (LCD). More specifically, the present invention is directed to an improvement in a signal electrode drive circuit employed in such a liquid crystal display.

2. Description of the Related Art

In a conventional image display apparatus capable of gradation-displaying information data on a dot-matrix type display panel such as a liquid crystal display, a $2^n$-gradation display is performed by supplying n-bit data to a signal electrode drive circuit ("n" being an integer). To increase the number of the pixels (picture elements) of the display panel, the data transfer frequency must be accordingly increased. In this case, the operation frequency of the signal electrode drive circuit must be set to be high in accordance with the signal transfer frequency. However, if the operation frequency of such an image display apparatus is increased, then a higher graded circuit is required. As a result, various limitations may be provided with the circuitry, and higher power is consumed and furthermore occurrence of noise is emphasized.

FIG. 1 illustrates a major circuit arrangement of a conventional liquid crystal drive circuit (segment driver circuit). Such a signal electrode drive circuit is known from, for instance, U.S. Pat. No. 4,581,654.

The circuit arrangement shown in FIG. 1 is constructed as follows. There is employed a shift register 11. Shift register sections 11*a*, 11*b*, —of each stage are constructed in a three-bit arrangement, for example, by D-type flip-flops. In this shift register 11, the 3-bit data D1 to D3 which are transferred from an A/D (analog-to-digital) converter (not shown) employed in front of these shift registers, are read out by 2-phase clock pulses $\phi$1 and $\phi$2, and then sequentially shifted along the shift register sections 11*a*, 11*b*, —. When 1-line data has been set in these register sections 11*a*, 11*b*, —of the shift register 11, a latch pulse $\phi_L$ is applied thereto, and thus the data held in these shift register sections 11*a*, 11*b*, —are latched in the latch circuits 12*a*, 12*b*, —. Thereafter, the data are transferred to a drive circuit (not shown). In the drive circuit, for instance, an 8-gradation drive signal is produced based upon the data latched in these latch circuits 12*a*, 12*b*, —, whereby the segment electrodes of the liquid crystal display panel are driven for displaying the desired data.

However, in the conventional drive circuit with the above-described circuit arrangement, the clock pulses $\phi$1 and $\phi$2, and the data transfer frequency for shifting the data in the shift register sections 11*a*, 11*b*, —, of the shift register 11 are equal to the sampling frequencies of the input data D1 to D3 As a consequence, the transfer frequency is limited to the operation frequency of the signal electrode drive circuit, so that this transfer frequency cannot be selected to be so high. To the contrary, if the signal electrode drive circuit is designed to be operative under a higher frequency, high-graded circuitry is necessarily required, resulting in an expensive circuit cost. In accordance with the higher operation frequency, larger power consumption occurs and much noise is produced.

SUMMARY OF THE INVENTION

The present invention has been accomplished in an attempt to solve the problems mentioned above, and therefore has an object to provide an image display apparatus where even if the operation frequency of the signal electrode drive circuit is not so high, the data, or equivalent data which are processed in the signal electrode drive circuit operated under a high frequency can be processed in the first-mentioned signal electrode drive circuit.

To achieve the above object of the present invention, the signal electrode drive circuit of an image display apparatus according to the invention is arranged by comprising:

a pair of buffer circuits for alternately reading n-bit digital video data ("n" being an integer) by clock pulses having different phases;

a latch clock generator circuit for generating two-phase latch clocks having sequentially different phases by sequentially shifting a latch timing signal by the two-phase latch clocks;

a plurality of latch circuits for sequentially latching said n-bit digital video data held in said buffer circuit in synchronism with each of said two-phase latch clocks output from said latch clock generating circuit; and, readout means for reading entirely the data temporarily stored in said plurality of latch circuits within a predetermined timing period.

According to the invention, in the image display apparatus where the image data is sequentially latched by sequentially shifting the latch pulses for a plurality of latch circuits, and based on the image data latched on the latch circuits, the signal electrode of the dot-matrix type display panel is driven to display image data by a signal having a plurality of gradations, the image input data are alternately read out via the buffer circuits by the two-phase clock pulses, and the resultant data are transferred to the latch circuit by the two-phase latch clocks. As a result, the operation frequency of the signal electrode drive circuit can be selected to be a half of the transfer frequency of the image input data.

In addition, according to the present invention, the image input data are subdivided into two data processing lines via the buffer circuits by the two-phase clock pulses, and output data from the respective data systems are converted into data having the same phases with each other, and thereafter, these converted data are transferred via the respective data bus lines for each signal system to the latch circuits. As a consequence, the operation frequencies of the respective data processing lines can be selected to be a half of the transfer frequency of the image input data. Moreover, according to the present invention, the transfer data can be latched by the 1-phase latch clock for the latch circuits employed in two data processing lines. Accordingly, only a single signal line for a latch clock is sufficient for the latch circuits. In other words, the circuit arrangement of the latch clock can be simplified.

BRIEF DESCRIPTION OF THE DRAWINGS

The invention will be more readily understood on reading the following description with reference to the accompanying drawings; in which.

Figure 1:
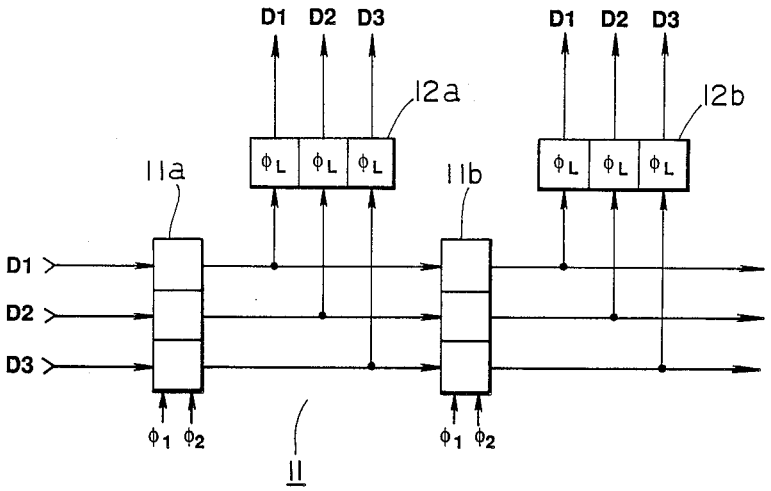
FIG. 1 (PRIOR ART)
FIG. 1 is a schematic circuit diagram of a conventional signal electrode drive circuit employed in a conventional image display apparatus.

DETAILED DESCRIPTION OF THE PREFERRED EMBODIMENTS Circuit Arrangement of First Signal Electrode Drive Circuit Referring now to FIG. 2, a circuit arrangement of a signal electrode drive circuit according to a first preferred embodiment of the invention will be described. It should be noted that the same reference numerals employed in FIG. 1 will be employed as those for denoting the same or similar circuit elements in the following figures.

Figure 2:
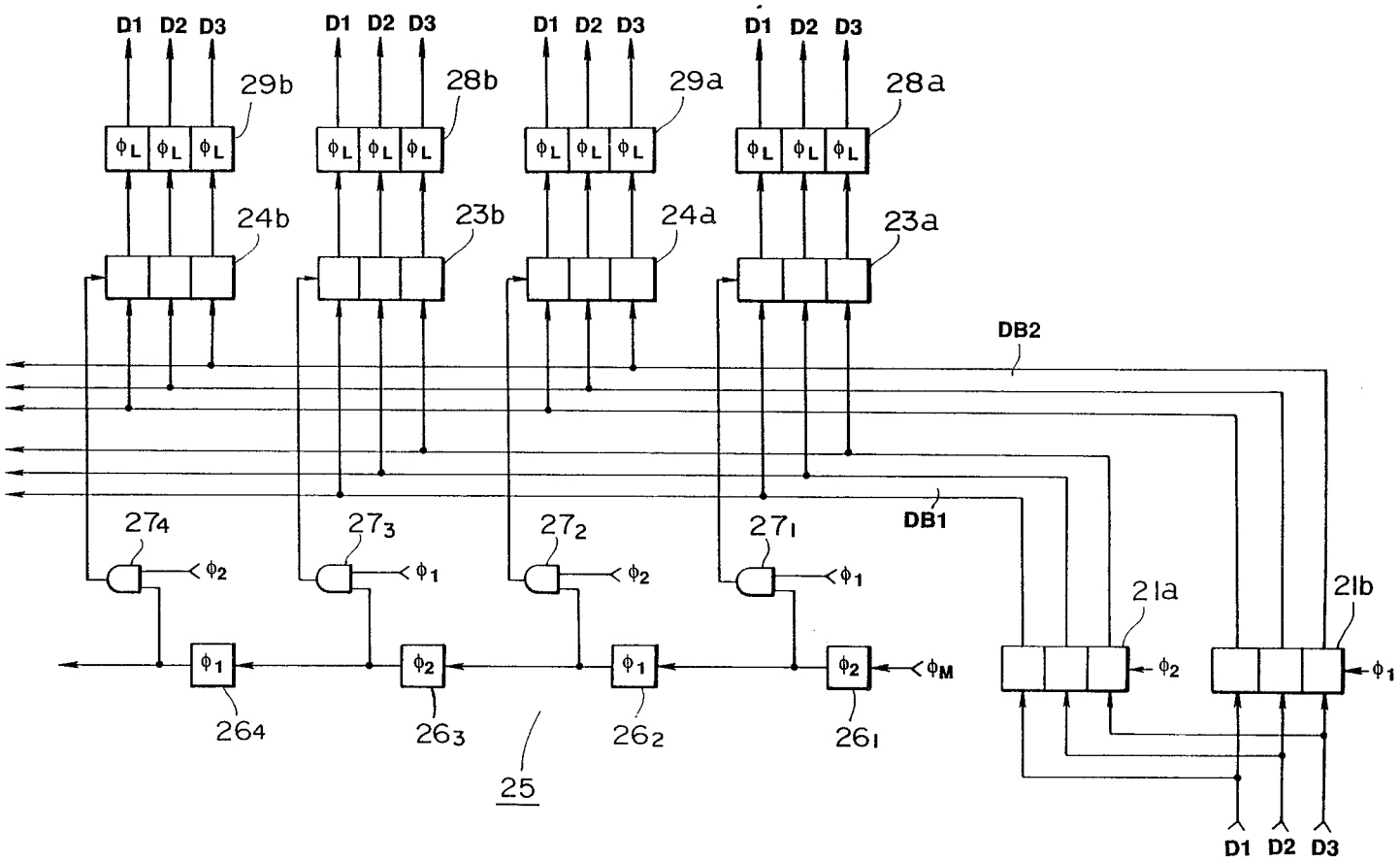
FIG. 2 is a schematic circuit diagram of a signal electrode drive circuit employed in an image display apparatus according to a first preferred embodiment of the invention.

In the circuit arrangement shown in FIG. 2, n-bit, e.g., 3-bit display data D1 to D3 which have been transferred from an A/D (analog-to-digital) converter (not shown) provided in front of the following buffers are input into 3-bit buffers 21*a* and 21*b*. In the first buffer 21*a*, the input data D1 to D3 are read in synchronism with the clock pulse $\phi 2$ supplied from the timing signal generator circuit (not show in detail) whereas in the second buffer 21*b*, these input data D1 to D3 are read in synchronism with the clock pulse $\phi 1$ supplied therefrom. It should be noted that the above-described clock pulses $\phi 1$ and $\phi 2$ are two-phase clock pulses having the same frequencies and different phases from each other by 180°. The data stored in the first buffer 21*a* is transferred via a data bus line DB1 to latch circuits 23*a*, 23*b*, —, whereas the data stored in the second buffer 21*b* is transferred via a data bus line DB2 to latch circuits 24*a*, 24*b*, —. These latch circuits 23*a*, 23*b*, —are employed corresponding to odd-numbered signal electrodes (segment electrodes) of a dot-matrix type display panel, e.g., a liquid crystal display panel (not shown in detail), whereas other latch circuits 24*a*, 24*b*, —are provided, corresponding to even-numbered signal electrodes, or segment electrodes thereof. The latch clocks derived from the latch clock generator circuit 25 are supplied to these latch circuits 23*a*, 23*b*, —, 24*a*, 24*b*, —, respectively. This latch clock generator circuit 25 is constructed of edge-trigger type flip-flops $26_1$, $26_2$, —and AND gate circuits $27_1$, $27_2$, —, and these flip-flops $26_1$, $26_2$, —constitute a shift register. In synchronism with the clock pulse $\phi 2$, the odd-numbered flip-flops $26_1$, $26_3$, —are operated, flip-flops $26_2$, 264, —are operated. In these flip-flops $26_1$, $26_2$, $26_3$, 264, —, the latch timing signal $\phi_M$ supplied from the timing signal generator circuit is sequentially shifted in synchronism with the clock pulses $\phi 2$ and $\phi 1$, and the output signals from these flip-flops are input into the AND gate circuits $27_1$, $27_2$, —, respectively. The above-described latch timing signal $\phi_M$ corresponds to a starting signal supplied in synchronism with the horizontal synchronization signal. To the odd-numbered AND gate circuits $27_1$, $27_3$, —, the clock pulse $\phi 1$ is supplied, whereas the other clock pulse $\phi 2$ is supplied to the even-numbered AND gate circuits $27_2$, $27_4$, —. The output signals derived from the odd-numbered AND gate circuits $27_1$, $27_3$, —are supplied as a latch clock to the latch circuits 23*a*, 23*b*, —, whereas the output signals derived from the even-numbered AND gate circuits $27_2$, $27_4$ —are supplied as a latch clock to the latch circuits 23*a*, 23*b*, —.

The latch circuits 23*a*, 23*b*, —, 24*a*, 24*b*, —latch the input data in synchronism with the latch clocks derived from the latch clock generator circuit 25, and thereafter output the latched input data to the 3-bit latch circuits 28*a*, 28*b*, —, 29*a*, 29*b*, —.

Figure 3:
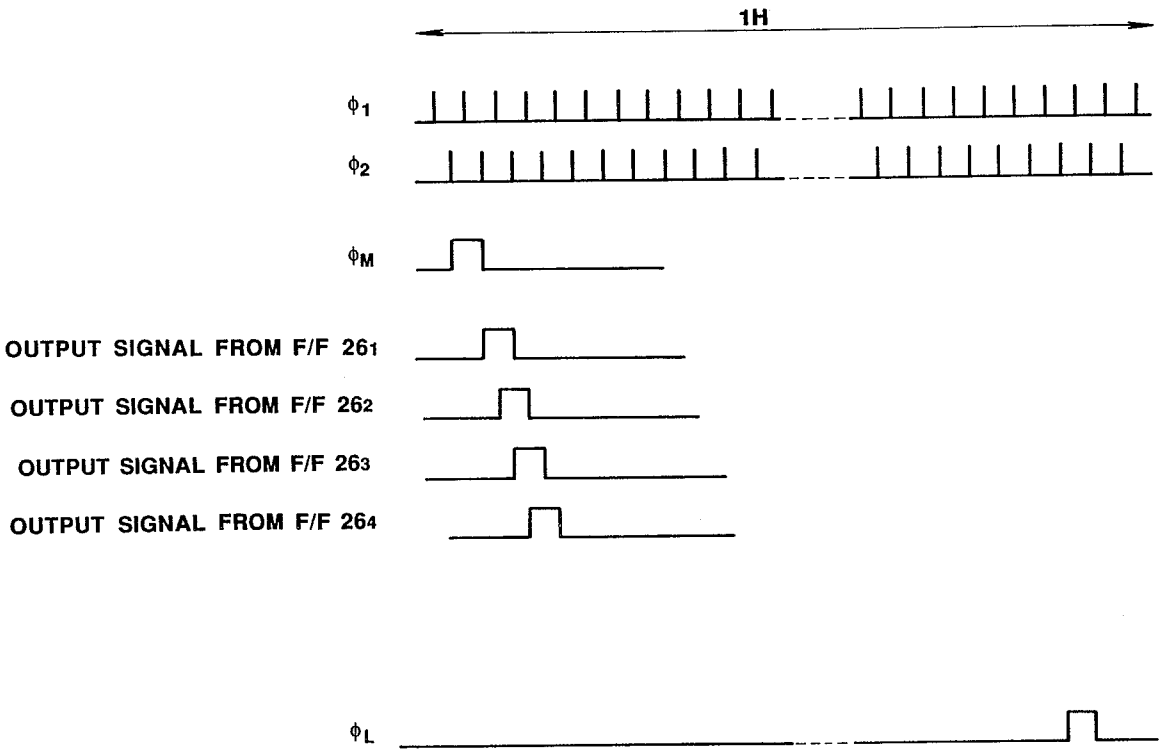
FIG. 3 is a timing chart of the signals appearing in the signal electrode drive circuit shown in FIG. 2.

These -3-bit latch circuits 28*a*, 28*b*, —, 29*a*, 29*b*, —latch input data in synchronism with the latch pulse $\phi_L$ derived from the timing signal generator circuit, and then output the latched data D1 to D3 to the drive circuits of the signal electrodes of the LCD panel (not shown). The drive circuits produce an 8-gradation drive signal based upon the above-described latched data D1 to D3 so as to drive the signal electrodes (segment electrodes) of the liquid crystal display panel. The above-described latch pulse $\phi_L$ corresponds to a signal which is supplied in synchronism with the horizontal synchronization signal of the liquid crystal display panel. FIG. 3 shows a timing chart for explaining relationships between the above-described clock pulses $\phi 1$, $\phi 2$, latch timing signals $\phi_M$ and latch pulse $\phi_L$.

Operation of First Signal Electrode Drive Circuit

An operation of the signal electrode drive circuit according to the first preferred embodiment will now be described with reference to FIGS. 2 and 3.

The A/D converter (not shown) is operated in synchronism with the clock pulses $\phi 1$ and $\phi 2$ to convert the analog image (video) signal into the above-described digital data D1 to D3. That is to say, the A/D converter alternately A/D-converts the image signal for 1 horizontal scanning period in response to the clock pulses $\phi 1$ and $\phi 2$ and then outputs the A/D-converted data to the first and second buffers 21*a*, 21*b*, respectively. First, the digital data D1 to D3 which have been A/D-converted in response to the first clock pulse $\phi 1$, are read so as to be temporarily stored in the buffer 21*a* in synchronism with the clock pulse $\phi 2$, and subsequently, the digital data D1 to D3 which have been A/D converted in response to the second clock pulse $\phi 2$, are read in order to be temporarily stored in the buffer 21*b* in synchronism with the clock pulse $\phi 1$. The digital data temporarily stored into the buffer 21*a* are sent via the corresponding data bus lines DB1 to the latch circuits 23*a*, 23*b*, —, whereas the digital data temporarily stored in the buffer 21*b* are transferred via the corresponding data bus line DB2 to the latch circuits 24*a*, 24*b*, —.

In the meantime, the latch timing signal $\phi_M$ (see FIG. 3) is supplied to the latch clock generator circuit 25 at the starting timing of the respective horizontal scanning periods. In the latch clock generator circuit 25, this latch timing signal $\phi_M$ is read in the flip-flop $26_1$ in synchronism with the clock pulse $\phi 2$, and thereafter input into both the AND gate circuit $27_1$ and flip-flop $26_2$. As a result, the clock pulse $\phi 1$ which will be subsequently supplied is output from the AND gate circuit $27_1$, and transferred as the latch clock to the latch circuit 23a. As a consequence, this latch circuit 23a will latch the digital data supplied from the first buffer 21a via the data bus line DB1. The output from the flip-flop $26_1$ is read in the flip-flop $26_2$ at the timing of the clock pulse $\phi 1$, and then input into the AND gate circuit $27_2$ and flip-flop $26_3$. Accordingly, the clock pulse $\phi 2$ which is subsequently supplied thereto is output from the AND gate circuit $27_2$, and then transferred to the latch circuit 24a as the latch clock. As a result, this latch circuit 24a will latch the digital data supplied thereto via the data bus line DB2 from the second buffer 21b.

Similarly, the data D1 to D3 which are transferred from the A/D converter in synchronism with the clock pulses $\phi 1$ and $\phi 2$, are read in the first and second buffers 21a and 21b, and thereafter sequentially latched in the latch circuits 23a, 23b, —, 24a, 24b, —, in response to the latch clocks output from the latch clock generator circuit 25. When the 1-line data are once latched in the latch circuits 23a, 23b, —, 24a, 24b, —, then the latch pulse $\phi_L$ (see FIG. 3) is supplied thereto, so that the data which have been latched in the latch circuits 23a, 23b, —, 24a, 24b, —, are transferred to the latch circuits 28a, 28b, —, 29a, 29b, —, and then are transferred as the image data D1 to D3 to the drive circuit (not shown). In this signal electrode drive circuit, the 8-gradation drive signal is produced based upon the data derived from the latch circuits 28a, 28b, —, 29a, 29b, —, whereby the signal electrodes of the liquid crystal display panel are driven for displaying the image data D1 to D3 thereon.

As previously described in detail, in the signal electrode drive circuit according to the first preferred embodiment, the input data D1 to D3 supplied from the A/D converter are alternately stored in the first and second buffers 21a and 21b, and thereafter transferred via the data bus lines DB1 and DB2 to the latch circuits 23a, 23b, —, 24a, 24b, —. As a consequence, the input data D1 to D3 are separated and processed into the two data processing lines, and therefore, the operation frequencies for the respective data processing lines are selected to be a half of the transfer frequency for the input data D1 to D3.

Circuit Arrangement of Second Signal Electrode Drive Circuit

Figure 4:
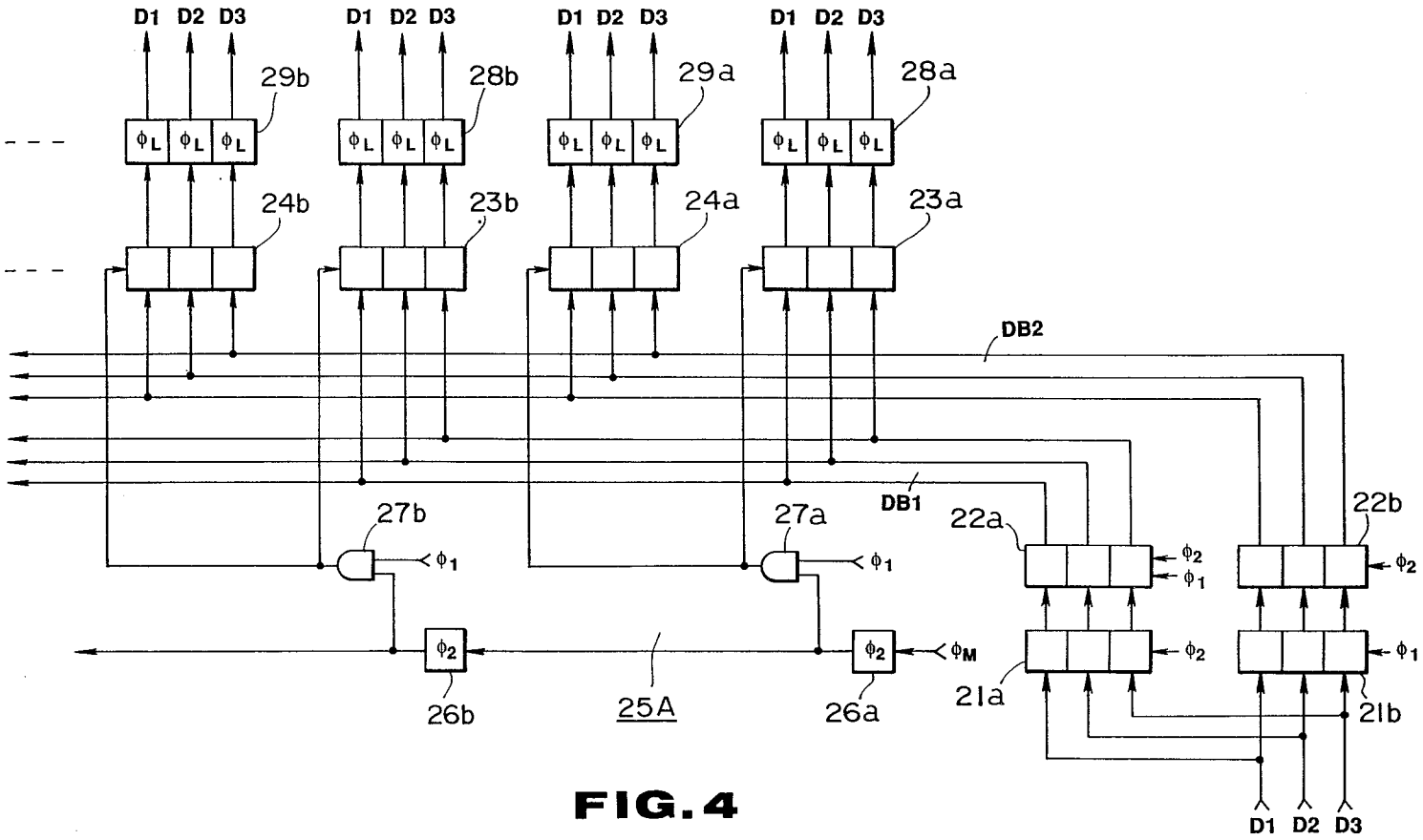
FIG. 4 is a schematic circuit diagram of a signal electrode drive circuit employed in an image display apparatus according to a second preferred embodiment of the invention.

In FIG. 4, there is shown a circuit arrangement of a signal electrode drive circuit according to a second preferred embodiment of the invention.

In the circuit arrangement of FIG. 4, the 3-bit display data D1 to D3 which have been transferred from the A/D converter (not shown) provided in a stage preceding the first and second buffers 21a and 21b, are input into the first and second buffers 21a and 21b. In the first buffer 21a, the input data D1 to D3 are read in timing signal generator circuit (not shown in detail), whereas in the second buffer 21b, these input data D1 to D3 are read in synchronism with the clock pulse $\phi 1$ supplied therefrom. The data which have been held in the above buffers 21a, 21b are transferred to 3-bit buffers 22a, and 22b respectively. The first buffer 22a reads the input data in response to the clock pulse $\phi 1$ to output them in response to the clock pulse $\phi 2$, whereas the second buffer 22b reads the input data in response to the clock pulse $\phi 2$ and directly outputs them.

Figure 5:
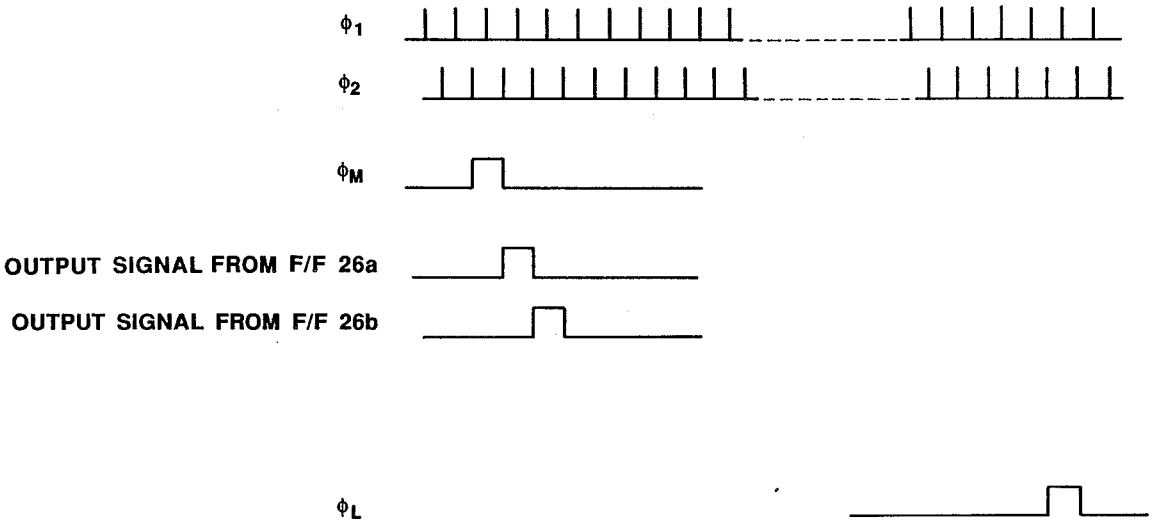
FIG. 5 is a timing chart of the signals appearing in the signal electrode drive circuit shown in FIG. 4.

The data stored in the first buffer 22a is transferred via the data bus line DB1 to the latch circuits 23a, 23b, —, whereas the data stored in the second buffer 22b is transferred via the data bus line DB2 to the latch circuits 24a, 24b, —. The latch clocks derived from the latch clock generator circuit 25A are supplied to these latch circuits 23a, 23b, —, 24a, 24b, —, respectively. This latch clock generator circuit 25A is constructed of edge-trigger type flip-flops 26a, 26b, — and AND gate circuits 27a, 27b, —, which are operated in synchronism with the clock pulse $\phi 2$ and these flip-flops 26a, 26b, —constitute a shift register. In these flip-flops 26a, 26b,—, the latch timing signal $\phi_M$ supplied from the timing signal generator circuit is sequentially shifted in synchronism with the clock pulses $\phi 2$, and the respective output signals from these flip-flops 26a, 26b are input into the AND gate circuits 27a, 27b, —, respectively. To these AND gate circuits 27a, 27b, —, the clock pulse $\phi 1$ is supplied, and the output signals from the respective AND gate circuits 27a, 27b are supplied to the latch circuits 23a, 23b, —, and latch circuits 24a, 24b, —, as the latch clock. The latch circuits 23a, 23b, —, 24a, 24b, —latch the input data in synchronism with the latch clocks derived from the latch clock generator circuit 25A, and thereafter output the latched input data to the 3-bit latch circuits 28a, 28b, —, 29a, 29b, —. These 3-bit latch circuits 28a, 28b, —, 29a, 29b, —latch the input data in synchronism with the latch pulse $\phi_L$ derived from the timing signal generator circuit, and then output the latched, data D1 to D3 to the drive circuits of the signal electrodes of the LCD panel (not shown). The drive circuits produce an 8-gradation drive signal based upon the above-described latched data D1 to D3, so as to drive the signal electrodes (segment electrodes) of the liquid crystal display panel. FIG. 5 shows a timing chart for explaining relationships between the above-described clock pulses $\phi 1$, $\phi 2$ latch timing signals $\phi_M$ and latch pulse $\phi_L$.

Operation of Second Signal Electrode Drive Circuit

An operation of the signal electrode drive circuit according to the second preferred embodiment will now be described with reference to FIGS. 4 and 5.

The A/D converter (not shown) is operated in synchronism with the clock pulses $\phi 1$ and $\phi 2$ to convert the analog image (video) signal into the above-described digital data D1 to D3. That is to say, the A/D converter alternately A/D-converts the image signal for each 1-horizontal scanning period in response to the clock pulses $\phi 1$ and $\phi 2$ and then outputs the A/D-converted data to the first and second buffers 21a, 21b, respectively. First, the digital data D1 to D3 which have been A/D-converted in response to the first clock pulse $\phi 1$, are read so as to be temporarily stored in the buffer 21a in synchronism with the clock pulse $\phi 2$, and subsequently, the digital data D1 to D3 which have been A/D-converted in response to the second clock pulse $\phi 2$, are read in order to be temporarily stored in the buffer 21b in synchronism with the clock pulse $\phi 1$. These digital data temporarily stored into the buffer 21a are sent via the corresponding data bus lines DB1 to the buffer 22a in response to the clock pulse $\phi 1$, and then these data are output from this buffer 22a in response to the clock pulse $\phi 2$, whereas the digital data temporarily stored in the buffer 21b are transferred into the buffer 22b in synchronism with the clock pulse $\phi 2$, and immediately output therefrom. As a result, the digital data which have been transferred from the A/D converter in response to the clock pulses $\phi 1$ and $\phi 2$ having the different timings, are output from the buffers 22a and 22b at the same timing in synchronism with the clock pulse $\phi 2$, and thereafter transferred via the data bus lined DB1 and DB2 to the latch circuits 23*a*, 23*b*, —, 24*a*, 24*b*, —.

In the meantime, in the latch clock generator circuit 25A, the latch timing signal $\phi_M$ which is supplied at the starting timing of the respective horizontal scanning periods is read into the flip-flop 26*a* in synchronism with the clock pulse $\phi 2$, namely at the timing at when the data held in the buffer circuits 21*a*, 21*b* are output via the buffer circuits 22*a*, 22*b*. As a result, the clock pulse $\phi 1$ which will be subsequently supplied is output from the AND gate circuit 27*a*, and transferred as the latch pulse to the latch circuits 23*a*and 23*b*. As a consequence, these latch circuits 23*a*, 23*b* will latch the digital data supplied from the first and second buffers 21*a*, 21*b* via the corresponding data bus line DB1, DB2, and thereafter output these digital data to the latch circuits 28*a*, 29*a*.

Similarly, the data D1 to D3 which are transferred from the A/D converter in synchronism with the clock pulses $\phi 1$ and $\phi 2$, are read in the first and second buffers 21*a* and 21*b*, and thereafter sequentially latched in the latch circuits 23*a*, 23*b*, —, 24*a*, 24*b*, —, in response to the latch clocks output from the latch clock generator circuit 25A under the same output timing. When the 1-line data are once latched in the latch circuits 23*a*, 23*b*, —, 24*a*, 24*b*, —, then the latch pulse $\phi_L$ is supplied thereto, so that the data which have been latched in the latch circuits 23*a*, 23*b*, —, 24*a*, 24*b*, —are transferred to the latch circuits 28*a*, 28*b*, —, 29*a*, 29*b*, —, and then are transferred as the image data D1 to D3 to the drive circuits (not shown). In the signal electrode drive circuits, the 8-gradation drive signal is produced based upon the data derived from the latch circuits 28*a*, 28*b*, —, 29*a*, 29*b*, —, whereby the signal electrodes of the liquid crystal display panel are driven for displaying the image data D1 to D3 thereon.

As previously described in detail, in the signal electrode drive circuit according to the second preferred embodiment, the input data D1 to D3 supplied from the A/D converter are alternately stored in the first and second buffers 21*a* and 21*b*, and thereafter transferred via the two data processing systems of the data bus lines DB1 and DB2 to the latch circuits 23*a*, 23*b*, —, 24*a*, 24*b*, —, under the condition that the phases of the input data are coincident with each other by means of the buffers 22*a*, 22*b*. As a consequence, the operation frequencies of the respective data processing systems can be selected to be a half of the transfer frequencies of the input data D1 to D3. In addition, the transferred data can be latched in the latch circuits 23*a* and 23*b* in response to the 1-phase latch clock derived from the latch clock generator circuit 25A.

Image Display Apparatus

Figure 6:
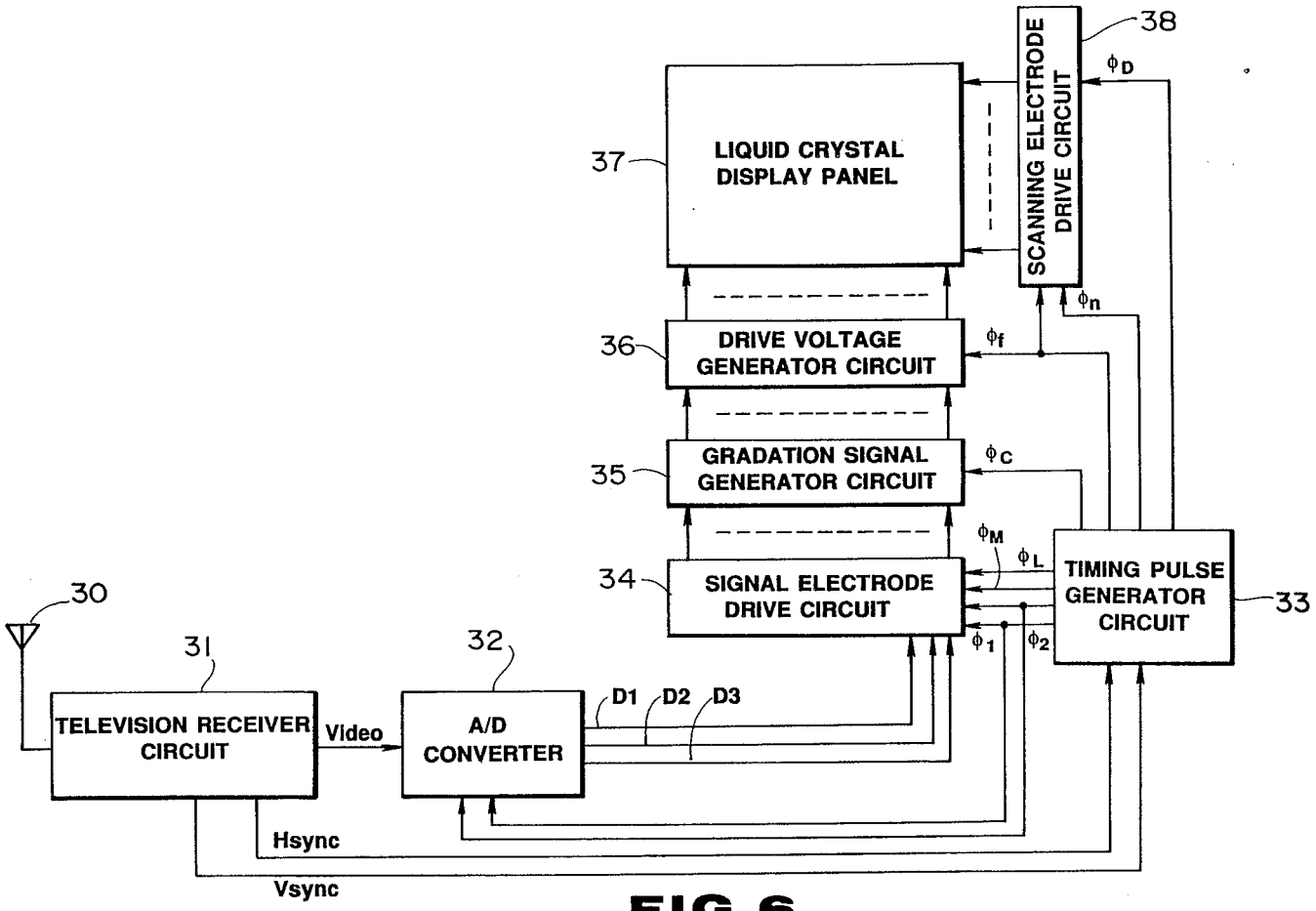
FIG. 6 is a schematic block diagram of an image display apparatus to which the signal electrode drive circuit according to the invention has been applied; and, FIG. 7 is a schematic block diagram of a major circuit portion of another image display apparatus to which the signal electrode drive circuit according to the invention has also been applied.

FIG. 6 is a block diagram of an image display apparatus employing the signal electrode drive circuit according to the invention. In the circuit shown in FIG. 6, a television receiver circuit 31 is employed to receive the broadcasting waves via an antenna 30 and to output the received video signal to an A/D converter 32. From this television receiver circuit 31, both the vertical synchronization (sync) signal Vsync and horizontal synchronization (sync) signal Hsync are output to a timing pulse generator circuit 33. In the A/D converter 32, the input analog video signal is sampled in response to the clock pulses $\phi 1$ and $\phi 2$ supplied from the timing pulse generator circuit 33 to be converted into the 3-bit digital data D1 to D3. These 3-bit digital data D1 to D3 are input into a signal electrode drive circuit 34. As this signal electrode drive circuit 34, the signal electrode drive circuit 34, illustrated in FIG. 2 or 4, according to the first or second preferred embodiment of the invention may be utilized. That is to say, this signal electrode drive circuit 34 is operated in response to the clock pulses $\phi 1$, $\phi 2$, latch timing signal $\phi_M$ and latch clock $\phi_L$ (see FIG. 3 or 5) supplied from the timing pulse generator circuit 33 in order to output the 3-bit digital data D1 to D3 collected for 1-horizontal line period into a gradation signal generator circuit 35. The function of the gradation signal generator circuit 35 is to modulate the 3-bit digital data in the PWM (pulse width modulation) system in response to a gradation signal producing pulse $\phi_C$. Seven pulses of the gradation signal producing pulse $\phi_C$ are produced within one horizontal scanning period. Then, the gradation signal generator circuit 35 counts 0th to 7th gradation signal producing pulses $\phi_C$ in accordance with the above-described 3-bit digital data "000" to "111", whereby eight different PWM signals are generated. The PWM signals derived from the gradation signal generator circuit 35 are input into a drive voltage generator circuit 35. In response to the PWM signals, the drive voltage generator circuit 36 applies both an ON voltage and an OFF voltage to a liquid crystal display panel 37. Under this condition, these ON/OFF drive voltages are inverted in response to a frame signal $\phi_F$ to AC-drive the liquid crystal display panel 37. This frame signal $\phi_F$ is supplied from the timing pulse generator circuit 33 and inverted every 1 frame. Furthermore, a scanning electrode drive circuit 38 is interposed between the liquid crystal display panel 37 and the timing pulse generator circuit 33. This scanning electrode drive circuit 38 sequentially shifts one pulse $\phi_D$ which is output from the timing pulse generator circuit 33 at the scanning start timing, in response to a shift lock $\phi_n$ output every 1 scanning period, whereby the scanning electrodes of the liquid crystal display panel 37 are sequentially driven. In this case, this drive voltage is alternately inverted every one frame in response to the frame signal $\phi_F$, i.e., AC-driving being performed, which is similar to the AC driving operation of the signal electrode drive voltage generator circuit 36.

The function of the timing pulse generator circuit 33 is to produce the above-described various timing pulses, e.g., the frame signal $\phi_F$ in synchronism with the vertical and horizontal sync signals Vsync and Hsync supplied from the television receiver circuit 31.

In the image display apparatus with the above-described circuit arrangement, the video signal received from the television receiver circuit 31 is analog-to-digital-converted into the corresponding digital data in the A/D converter 32. The A/D-converted digital data is transferred in the signal electrode drive circuit 34 at the frequency of a half of the transfer frequency, from the A/D converter 32, and thereafter supplied via the gradation signal generator circuit 35 and drive voltage generator circuit 36 to the signal electrodes of the liquid crystal display panel 37. The liquid crystal display panel 37 is scanned by the scanning electrode drive circuit 38, whereby the multiplex display of the video signal is performed on this liquid crystal display panel 37.

While the present invention has been described, in the image display apparatus where the image data is sequentially latched by sequentially shifting the latch pulses for a plurality of latch circuits, and based on the image data latched on the latch circuits, the signal electrode of the dot-matrix type display panel is display-driven by a signal having a plurality of gradations, the image input data are alternately read out via the buffer circuits by the two-phase clock pulses, and the resultant data are transferred to the latch circuit by the two-phase latch clocks. As a result, the operation frequency of the signal electrode drive circuit can be selected to be a half of the transfer frequency of the image input data.

In addition, according to the present invention, the image input data are subdivided into two data processing lines via the buffer circuits by the two-phase clock pulses, and the output data from the respective data systems are converted into the data having the same phases with each other, and thereafter, these converted data are transferred via the respective data bus lines for each signal system to the latch circuits. As a consequence, the operation frequencies of the respective data systems can be selected to be a half of the transfer frequency of the image input data. Moreover, according to the present invention, the transfer data can be latched by the 1-phase latch clock for the latch circuits employed in two data processing systems. Accordingly, only a single signal line for a latch clock is sufficient for the latch circuits. In other words, the circuit arrangement of the latch clock can be simplified.

Modification of Image Display Apparatus

Figure 7:
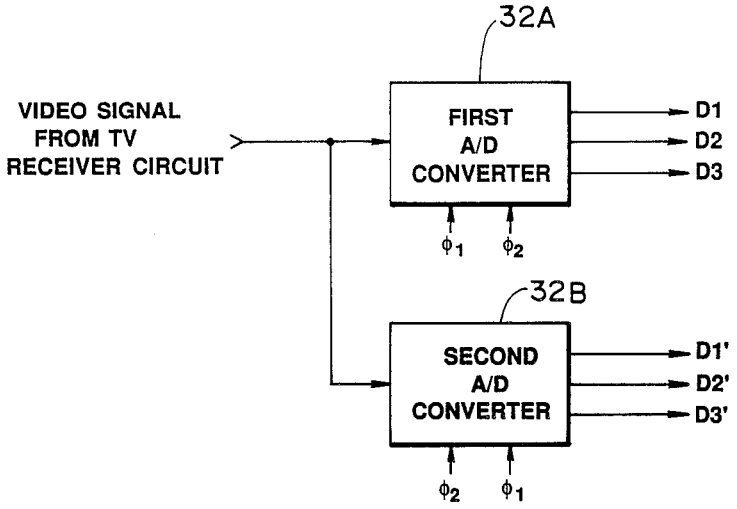

In FIG. 7, a major circuit portion of another image display apparatus is shown into which the signal electrode drive circuit according to the invention may be applied.

In the circuit shown in FIG. 7, the video signal derived from the television receiver circuit (not shown in detail) is supplied to a first A/D converter 32A and also a second A/D converter 32B. The first A/D converter 32A samples this video signal at the timing of the clock pulse $\phi$1, and then outputs the A/D-converted video signal at the timing of the clock pulse $\phi$2. The second A/D converter 32B samples this video signal at the timing of the clock pulse $\phi$2 and outputs the A/D-converted video signal at the timing of the clock pulse $\phi$1.

The A/D-converted video signal, i.e., digital video data "D1" to "D3" derived from the first A/D converter 32A are taken into a first buffer circuit (corresponding to the buffer circuit "**21*b*" shown in FIG. 2 or FIG. 4) in the signal electrode drive circuit (not shown in detail) at the timing of the clock pulse $\phi$1. Similarly, digital video data "D1'" through "D3'" output from the second A/D converter 32B are taken into a second buffer circuit (corresponding to the buffer circuit "21*a*" shown in FIG. 2 or FIG. 4) in the signal electrode drive circuit at the timing of the clock pulse $\phi$2. With the above-described circuit arrangement, the operation frequencies of the A/D converters can be reduced to 1/2**.

While the present invention has been described using a specific embodiment, it should be understood that further modifications and changes can be made without departing from the scope of the present invention.

In the above-described preferred embodiment, the digital data were transferred via the two data processing lines in the original electrode drive circuit. However, this digital data transfer may be carried out through three data processing lines, or more multiple lines.

Although the liquid crystal, display panel was employed as the display means in the above-described preferred embodiment, this display means is not limited thereto. For instance, an EL (electro-luminescent) display, a plasma display, and the like may be employed as the display means.

What is claimed is:

1. A signal electrode drive circuit for an image display apparatus having a number of signal electrodes to which gradation signals representing picture elements to be reproduced by the apparatus are applied, comprising:

data supplying means for supplying a digital video signal having a horizontal scanning period;

a first buffer circuit for fetching the digital video signal supplied from said data supplying means in response to periodic second clock signals;

a second buffer circuit for fetching the digital video signal supplied from said data supplying means in response to periodic first clock signals of a phase different from said second clock signals;

pulse generating means for generating a pulse in synchronism with the horizontal scanning period of said digital video signal;

a 2K-stage shift register, wherein K is a integer, including K odd-number stage flip-flops for reading data in response to said second clock signals, and K even-number stage flip-flops for reading data in response to said first clock signals and serially connected with the K odd-number stage flip-flops in an alternating manner, and wherein the first stage of said 2K-stage shift register is responsive to said pulse from said pulse generating means;

K first AND gate circuit means for receiving the outputs from said odd-number stage flip-flops of the shift register and said first clock signals, and for outputting corresponding logical signals;

K second AND gate circuit means for receiving the outputs from said even-number stage flip-flops of the shift register and said second clock signals, and for outputting corresponding logical signals;

K first latch circuits for latching data that has been read in said first buffer circuit in response to the logical signals from corresponding ones of the first gate circuit means;

K second latch circuits for latching data that has been read in said second buffer circuit in response to the logical signals from corresponding ones of the second gate circuit means; and reading means for reading 2K pieces of video data that are latched within a certain time period by both of said first and said second latch circuits, for driving 2K signal electrodes of the image display apparatus with said 2K pieces of video data.

2. An image display apparatus, according to claim 1, wherein said data supplying means includes television receiver means.

3. A signal electrode drive circuit as claimed in claim 1, wherein said data supplying means includes an A/D (analog-to-digital) converter.

4. A signal electrode drive circuit as claimed in claim 1, including a first bus line and a second bus line, and wherein said first buffer circuit is connected by said first bus line to said K first latch circuits, and said second buffer circuit is connected by said second bus line to said K second latch circuits.

5. A signal electrode drive circuit as claimed in claim 1, wherein said data supplying means includes;

a first analog-to-digital converter for outputting the digital video data to said first buffer circuit in response to said second clock signals; and a second analog-to-digital converter for outputting the digital video data to said second buffer circuit in response to said first clock signals.

6. A signal electrode drive circuit for an image display apparatus having a number of signal electrodes to which gradation signals representing picture elements to be reproduced by the apparatus are applied, comprising:

data supplying means for supplying digital video data having a horizontal scanning period;

a first buffer circuit for fetching the digital video data supplied from said data supplying means in response to an initial clock signal of second periodic clock signals, and for outputting the fetched digital video data in response to a succeeding clock signal of said second periodic clock signals produced after said initial clock signal;

a second buffer circuit for fetching the digital video data supplied from said data supplying means in response to first periodic clock signals of a phase different from said second periodic clock signals, and for outputting the fetched data in response to said second periodic clock signals;

pulse generating means for generating a pulse in synchronism with the horizontal scanning period of said digital video data;

a K-stage shift register, wherein K is an integer, including K stage flip-flops connected in series with one another for reading video data in response to said second periodic clock signals, and wherein the first stage of said K-stage shift register is responsive to said pulse from said pulse generating means;

K AND circuit means for receiving outputs from corresponding flip-flops of said shift register and said first periodic clock signals, and for outputting corresponding logical signals;

K pairs of latch circuits for simultaneously latching both that data which has been read in said first buffer circuit in response to the logical signals of said gate circuit means, and also that data which has been read in said second buffer circuit in response to said logical signals; and reading means for reading 2K pieces of video data that are latched within a certain time period by each pair of said K pairs of latch circuits, for driving 2K signal electrodes of the image display apparatus with said 2K pieces of video data.

7. A signal electrode drive circuit as claimed in claim 6, wherein said data supplying means includes television receiver means.

8. A signal electrode drive circuit as claimed in claim 6, wherein said data supplying means includes an A/D converter.

9. A signal electrode drive circuit as claimed in claim 6, including a first bus line and a second bus line, and wherein said first buffer circuit is connected by said first bus line to one of each pair of said K pairs of latch circuits, and said second buffer circuit is connected by said second bus line to the other one of each pair of said K pairs of latch circuits.

10. A signal electrode drive circuit as claimed in claim 6, wherein said data supplying means includes;

a first analog-to-digital converter for outputting the converted digital video data to said first buffer circuit in response to said second clock signals; and a second analog-to-digital converter for outputting the converted digital video data to said second buffer circuit in response to said first clock signals.

* * * * *